United States Patent [19]

Ishler

[11] Patent Number: 4,559,746

[45] Date of Patent: Dec. 24, 1985

[54] AIR-SUPPORTED FABRIC ROOF STRUCTURE

[75] Inventor: Michael W. Ishler, Toledo, Ohio

[73] Assignee: Owens-Corning Fiberglass Corporation, Toledo, Ohio

[21] Appl. No.: 643,117

[22] Filed: Aug. 22, 1984

[51] Int. Cl.[4] ..... E04B 1/34

[52] U.S. Cl. ..... 52/2; 52/63; 52/81

[58] Field of Search ..... 52/2, 63, 81

[56] References Cited

U.S. PATENT DOCUMENTS

| | | | |
|---|---|---|---|
| 3,590,448 | 7/1971 | Bryant | 52/81 |
| 3,744,191 | 7/1973 | Bird | 52/2 |
| 4,079,480 | 3/1978 | Oase | 52/584 X |
| 4,167,086 | 9/1979 | Oase | 52/2 |
| 4,214,407 | 7/1980 | Charter | 52/2 |
| 4,245,440 | 1/1981 | Oase | 52/83 |
| 4,288,947 | 9/1981 | Huang | 52/2 |

FOREIGN PATENT DOCUMENTS

| | | | |
|---|---|---|---|
| 2113407 | 10/1972 | Fed. Rep. of Germany | 52/2 |
| 2718097 | 10/1978 | Fed. Rep. of Germany | 52/2 |

*Primary Examiner*—Alfred C. Perham
*Assistant Examiner*—Jean M. LaKemper
*Attorney, Agent, or Firm*—Ronald C. Hudgens; Ted C. Gillespie; Paul J. Rose

[57] ABSTRACT

The air-supported fabric roof structure includes a compression ring, three sets of generally equally spaced parallel cables arranged to define a grid of generally equilateral triangles with each cable having a pair of opposite end portions pivotally connected to the compression ring, a plurality of hexagonal outer roof fabric panels secured to the cables from above and each covering six triangles of the grid, and a plurality of hexagonal inner liner panels secured to the cables from below and each covering six triangles of the grid, the liner panels preferably being staggered or laterally offset from the outer roof panels.

8 Claims, 13 Drawing Figures

AIR-SUPPORTED FABRIC ROOF STRUCTURE

TECHNICAL FIELD

This invention relates generally to fabric roof structures, and more particularly to air-supported fabric roof structures.

BACKGROUND ART

U.S. Pat. No. 4,079,480 discloses clamping means for clamping roof fabric to cables of an air-supported fabric roof. U.S. Pat. No. 4,245,440 discloses such clamping means at the intersection of two cables extending perpendicularly to each other. U.S. Pat. No. 4,167,086 discloses such clamping means at the connection of the cables to a concrete compression ring of a fabric roof. U.S. Pat. No. 3,744,191 discloses an air-supported fabric roof having a cable grid of equilateral triangles each covered by a triangular fabric panel.

DISCLOSURE OF INVENTION

As one example of the invention, an air-supported fabric roof structure for a circular building is disclosed. The structure includes a cable system with three sets of generally equally spaced, parallel cables arranged to define a grid of generally equilateral triangles, each cable having opposite end portions pivotally connected to a compression ring. The reason the cables of a set may not be truly equally spaced and the triangles of the grid may not be truly equilateral is because of the inflation of the roof into a three dimensional shape. Hexagonal panels of outer roof fabric are secured to the cables from above. Each hexagonal panel covers six triangles of the triangular grid and along each cable, fabric clamps are provided at intervals for generally only about one-third of the total cable length, the other two-thirds of a cable length being made up of the intervals which merely run beneath hexagonal panels not connected to that cable. Similar hexagonal inner liner panels are secured to the cables from below and preferably laterally offset or staggered from those of the outer roof structure.

BRIEF DESCRIPTION OF DRAWINGS

The invention is more fully explained hereinafter with reference to the accompanying drawings in which.

BEST MODE OF CARRYING OUT THE INVENTION

Figure 1:
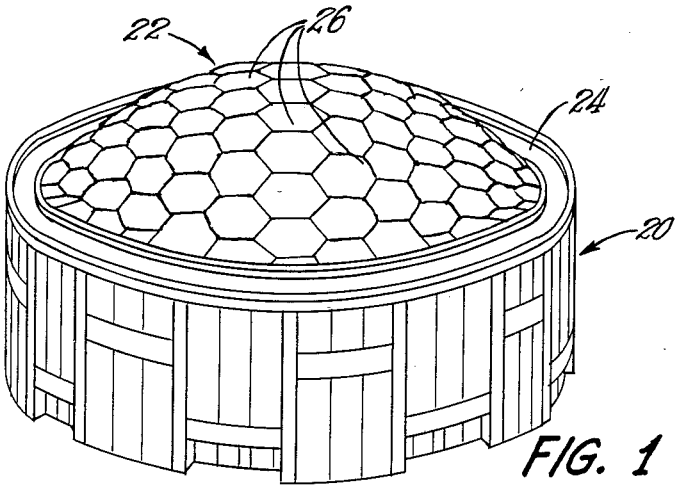
FIG. 1 is a perspective view of a circular building having an air-supported fabric roof constructed in accordance with the invention.
Figure 2:
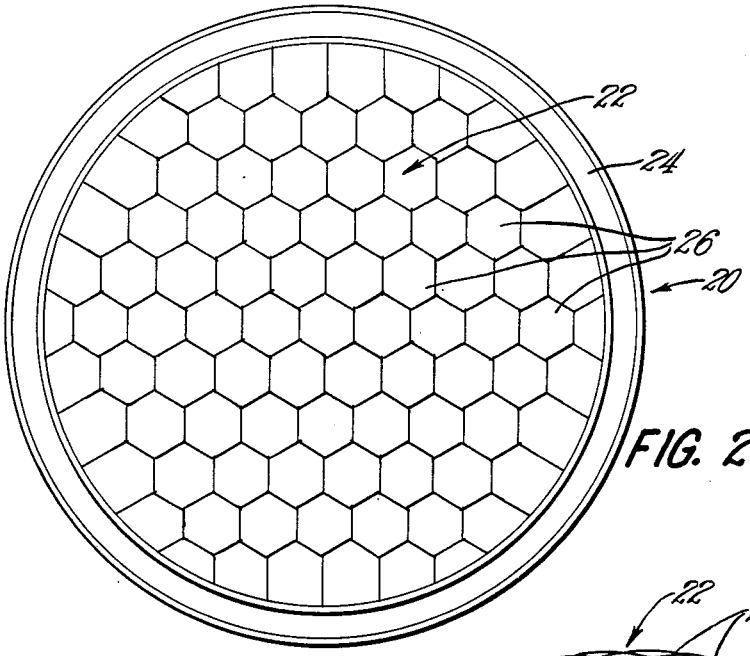
FIGS. 2 and 3 are plan and elevational views, respectively, of the building of FIG. 1.
Figure 3:
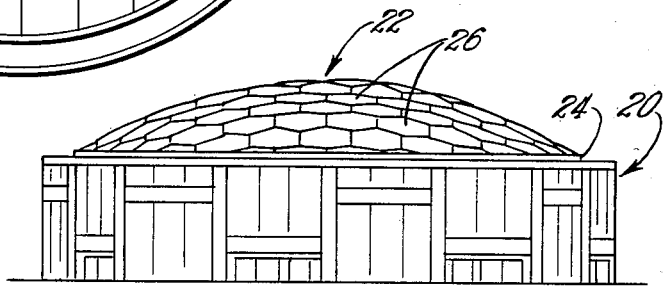
Figure 13:
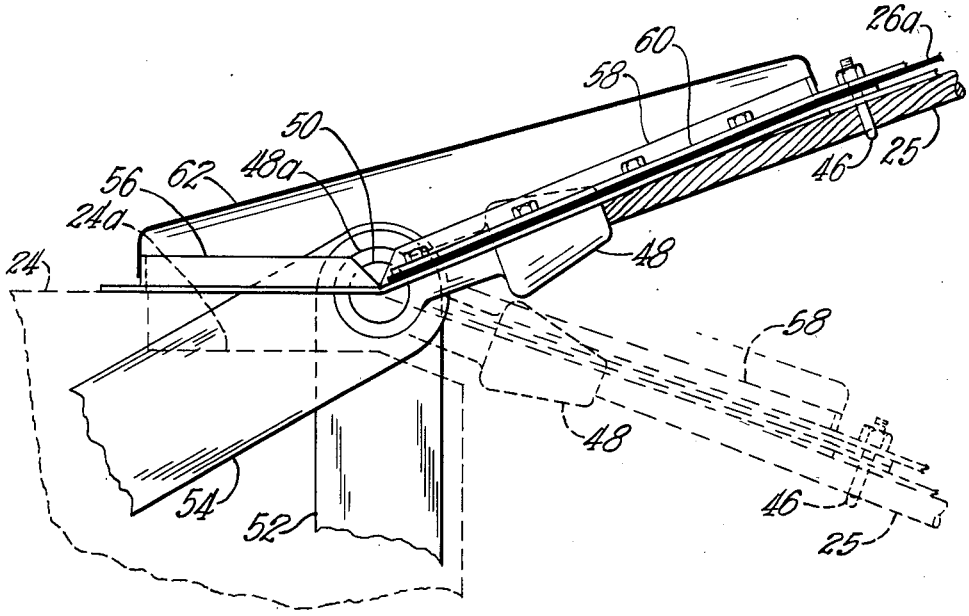
FIG. 13 is an elevational view showing the pivotal connection of a cable to a compression ring in accordance with the invention.

With reference to the drawings, FIGS. 1–3 show a circular building 20 as an example of a building having an air-supported fabric roof structure 22 constructed in accordance with the invention. The structure 22 includes a circular compression ring 24 made of concrete, steel, or other suitable material and serving as an anchor for a triangular grid pattern of cables 25 (FIG. 4), the cables 25 having a plurality of hexagonally shaped panels 26 of the outer roof fabric secured thereto in a manner later described. The cables 25 and roof fabric associated therewith are pivotally connected to the compression ring 24 in a manner such as shown in FIG. 13 and more fully described in U.S. Pat. No. 4,167,086, it being understood that some of the pivotable cable end sockets are modified to receive two or three cables extending angularly to each other.

Figure 4:
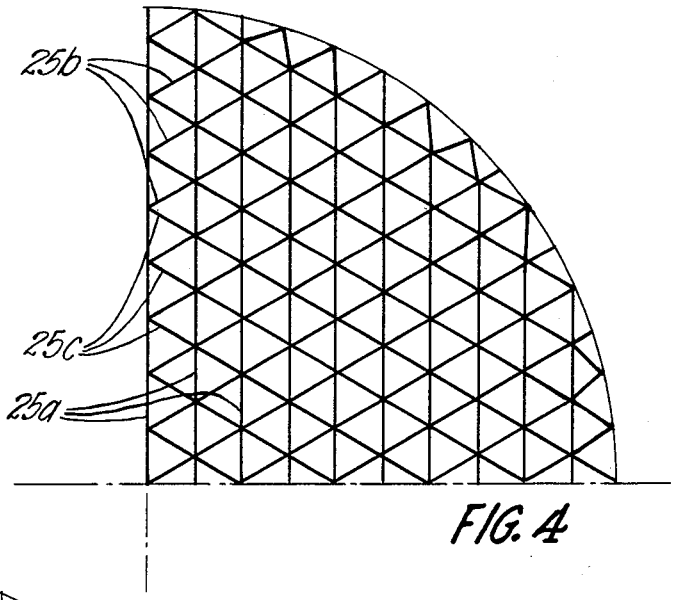
FIG. 4 is a schematic plan view of a quadrant of a triangular cable grid of the fabric roof structure of the invention as applied to a circular building.
Figure 8:
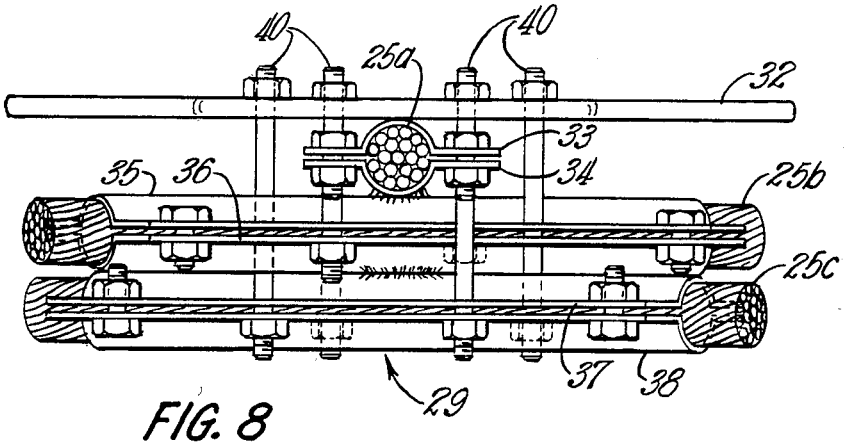

The cables 25 include an upper set of generally equally spaced parallel cables **25*a* extending vertically as viewed in FIG. 4, a middle set of generally equally spaced parallel cables 25*b* extending upwardly to the right, and a lower set of generally equally spaced parallel cables 25*c* extending upwardly to the left as viewed in FIG. 4, the upper cables 25*a* being spaced about one cable diameter above the cables 25*b* and the lower cables 25*c* being spaced about one cable diameter below the cables 25*b*, as shown in FIG. 8**.

Figure 5:
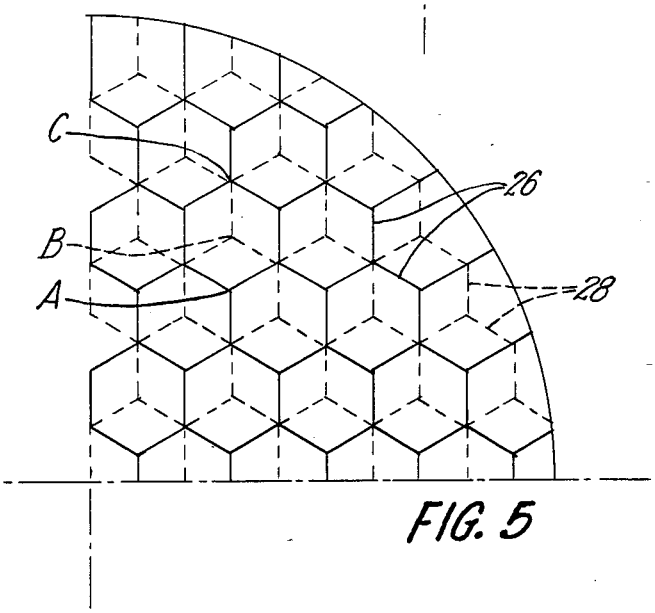
FIG. 5 is a schematic plan view of a quadrant of the fabric roof structure of the invention as applied to a circular building, showing hexagonal pieces of outer roof fabric in solid lines and hexagonal pieces of inner liner fabric in broken lines.

FIG. 5 shows a preferable construction in which the hexagonal fabric panels 26, shown in solid lines, are laterally offset from hexagonal inner liner panels 28, shown in broken lines.

Figure 6:
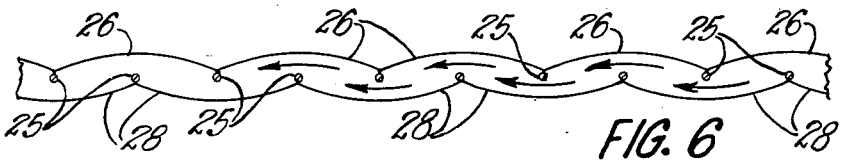
FIG. 6 is a schematic fragmentary vertical sectional view of the fabric roof structure of the invention.

FIG. 6 schematically shows a set of cables 25 having the outer roof fabric panels 26 secured thereto from above and having the inner liner panels 28 secured thereto from below in offset relationship to the panels 26. The arrows indicate a flow of heated air between the panels 26 and 28 for melting of snow whenever any snow accumulates on the outer roof fabric panels 26.

Figure 7:
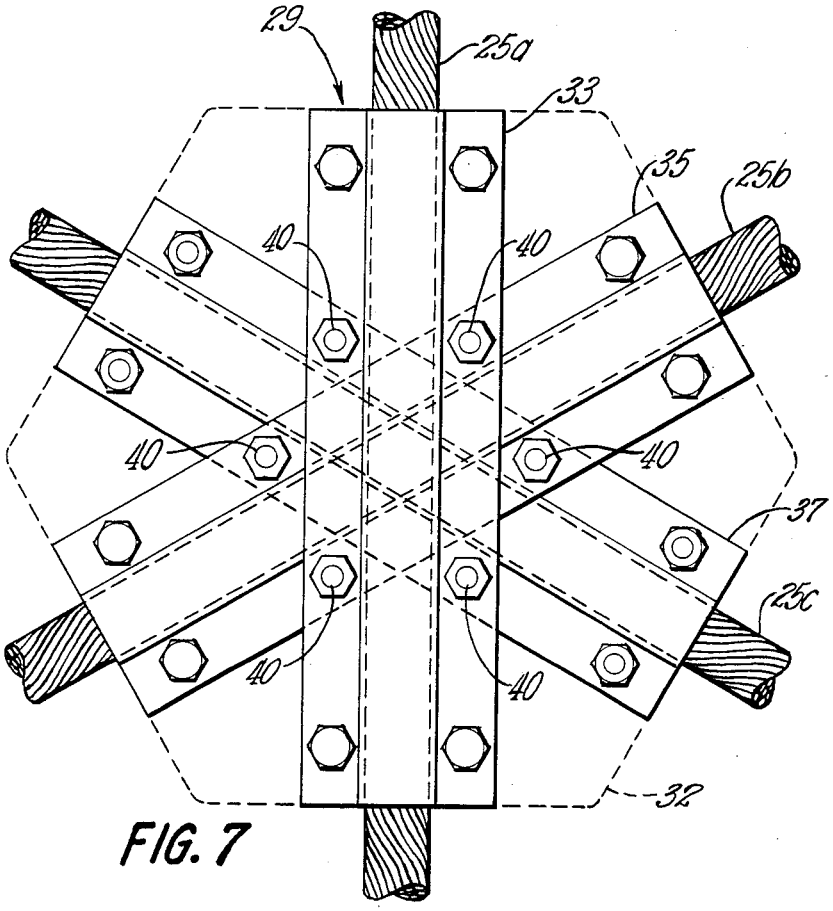
FIGS. 7 and 8 are fragmentary plan and elevational views, respectively, showing a joint between cables of the triangular cable grid of the roof structure of the invention.

The cables 25 are clamped together at every intersection. FIGS. 7 and 8 show such a clamping means 29 in association with a hexagonal base plate 32 above the cables, the plate 32 being shown in phantom in FIG. 7 for the purpose of clarity. The clamping means 29 includes upper and lower clamps 33 and 34 for the cable **25*a*, upper and lower clamps 35 and 36 for the cable 25*b*, and upper and lower clamps 37 and 38 for the cable 25*c*. The clamps 33–38 are identical. Preferably the clamp 34 is welded to the clamp 35 and the clamp 36 is welded to the clamp 37, the clamp assemblies 34–35 and 36–37 therefore being identical. The two clamps for each cable are secured together with suitable nuts and bolts, and the base plate 32 is secured in place above the clamp 34 by suitable means shown as six studs 40 each with a pair of nuts, four of the studs 40 extending through flanges of the clamp 38 and two being shorter and extending through flanges of the clamp 36. The clamping means 29 is used wherever three solid lines come together in FIG. 5** without any broken lines, as at point A, for example.

Figure 9:
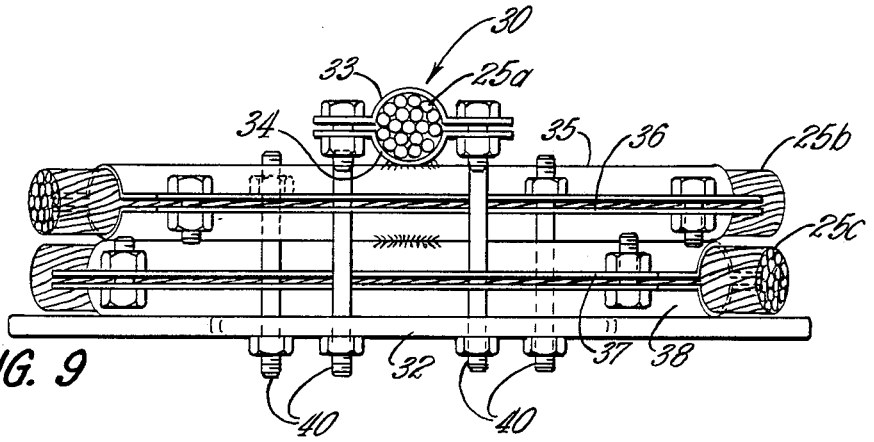
FIG. 9 is a view similar to FIG. 8, but with a hexagonal base plate for fabric clamping members beneath the cables, for association with inner liner fabric panels.

FIG. 9 shows a clamping means 30 similar to the clamping means 29 except that the hexagonal base plate 32 associated therewith is below the cables. The clamping means 30 is used wherever three broken lines come together in FIG. 5 without any solid lines, as at point B, for example.

Figure 10:
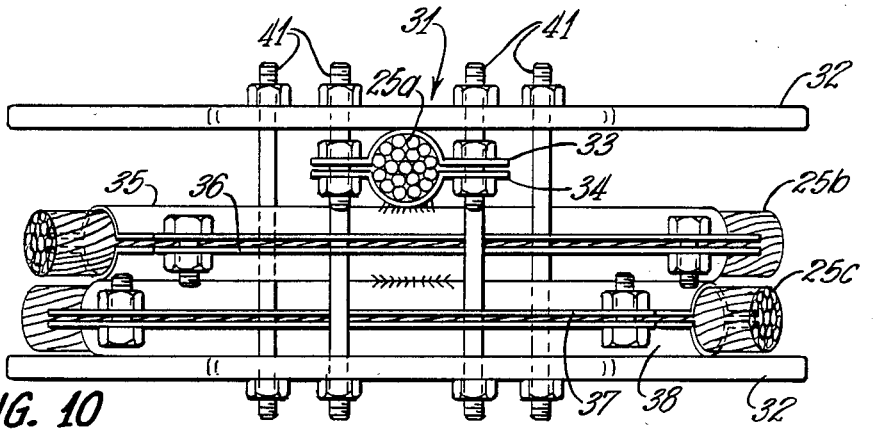
FIG. 10 is a view similar to FIGS. 8 and 9, but with hexagonal base plates respectively above and below the cables, for use at cable joints where both outer roof fabric panels and inner liner fabric panels must be clamped.

FIG. 10 shows a clamping means 31 similar to the clamping means 29 and 30 except that there are two of the hexagonal base plates 32 associated therewith, one above the cables and one below the cables, and the studs 41 are longer than the studs 40. The clamping means 31 is used wherever three solid lines and three broken lines come together in FIG. 5, as at point C, for example.

Figure 11:
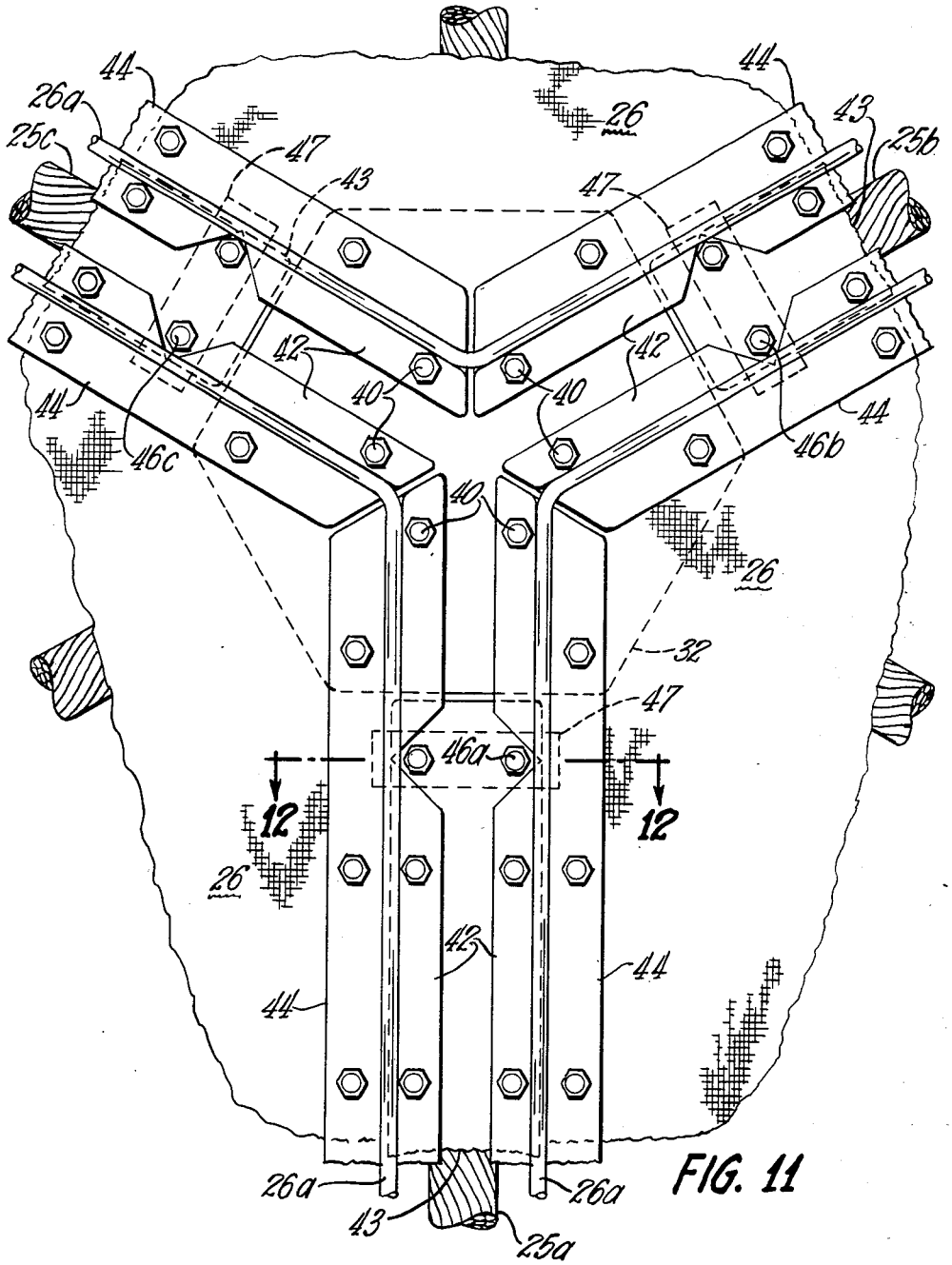
FIG. 11 is a fragmentary plan view of the roof structure of the invention at a joint between three hexagonal pieces of outer roof fabric.
Figure 12:
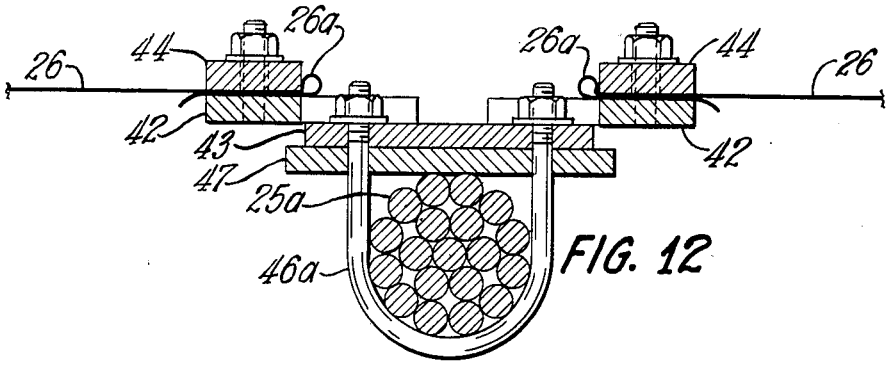
FIG. 12 is a sectional view taken generally along the line 12—12 of FIG. 11.

FIG. 11 shows the clamping of three of the hexagonal outer roof fabric panels 26 as at point A in FIG. 5, where the cable clamping means 29 of FIGS. 7 and 8 is used. End portions of six elongated lower clamp plates 42 are secured to the hexagonal base plate 32 respectively by the upper nuts on the studs 40. In each of three directions spaced 120 degrees apart, two of the lower clamp plates 42 extend away from the center of the hexagonal base plate 32 along one of the cables 25*a*, 25*b*, or 25*c*. Beyond the base plate 32, the two lower clamp plates 42 extending along each of the cables are suitably secured respectively to opposite longitudinal edge portions of an elongated base plate 43. Each of the hexagonal fabric panels 26 is provided with a beaded edge 26*a* and clamped adjacent the beaded edge to various ones of the lower clamp plates 42 by upper clamp plates 44, as more clearly shown in FIG. 12. Each base plate 43 is secured to its respective cable by U-bolts spaced therealong such as a U-bolt 46*a* having a small mounting plate 47 thereon beneath the plate 43. A U-bolt 46*b* (FIG. 11) for the cable 25*b* is longer than the U-bolt 46*a*, and a U-bolt 46*c* for the cable 25*c* is still longer, due to the fact that the cables 25*b* and 25*c* are progressively lower than the cable 25*a*. It will be understood that each of the U-bolts 46*b* and 46*c* has two of the mounting plates 47 separated by a pair of tubular spacers mounted respectively on the opposed leg portions of the U-bolt, as shown in FIG. 2 of U.S. Pat. No. 4,245,440.

Three hexagonal fabric panels 26 are similarly clamped at point C of FIG. 5, where the cable clamping means 31 of FIG. 10 is used. Further, three liner panels 28 are similarly clamped at point B of FIG. 5, where the cable clamping means 30 of FIG. 9 with the base plate 32 on the bottom is used, and at point C of FIG. 5, where the cable clamping means 31 of FIG. 10 is used.

The roof panels 26 are preferably made of coated glass fiber fabric. The liner panels 28 need not be as strong and can be made of various materials. Air pressure inside the building 20 slightly above atmospheric normally maintains the fabric and cables in a raised position.

FIG. 13 shows a pivotal connection of a cable 25 to the compression ring 24. An end of the cable is secured in a socket 48 having a pair of spaced arms 48*a*, only one of which is shown, pivotally mounted on a pin 50. The pin 50 is centrally supported in a notched portion 24*a* of the compression ring by a flat post 52 disposed between the arms 48*a*, the post 52 being anchored in the compression ring 24. Additional support for the pin 50 is provided by a pair of flat rods 54, only one of which is shown, the rods 54 also being disposed between the arms 48*a* respectively on opposite sides of the post 52 and anchored in the compression ring 24.

A stationary generally U-shaped frame 56 of generally L-shaped cross section is mounted on an upper surface of the compression ring 24 in partially surrounding relationship with the notch 24*a*. A movable generally U-shaped frame 58 of generally L-shaped cross section is pivotally mounted adjacent free end portions of opposed leg portions thereof on a pair of spaced pins (not shown) supported by the frame 56 and axially aligned with and disposed respectively on opposite sides of the pin 50, as shown in U.S. Pat. No. 4,167,086. The bight portion of the frame 58 is secured to the cable 25 by a U-bolt 46. Roof fabric 26*a* is clamped in partially surrounding relationship to the frame 58 by clamping strips such as the strip 60. An elastomeric cover 62 is mounted on the frames 56 and 58. The broken line position of the socket 48 and cable 25 indicates their position when the air-supported fabric roof 22 is deflated.

While the outer roof fabric panels 26 and the inner liner panels 28 are preferably offset from each other, they can be aligned with each other, in which case the clamping means 31 of FIG. 10 having two of the base plates 32 associated therewith is used at each corner of a hexagonal panel, and cable clamping means having no plates 32 associated therewith are used at the centers of the panels. This aligned construction has a more restricted air flow path between the liner and outer roof panels and is not practical for snow removal, but it has other advantages and can be used when there is no snow problem.

The invention has been illustrated with a circular compression ring 24 for a circular building 20, but can be used for buildings of other shapes such as hexagonal, triangular, oval, rectangular, elliptical, square, and other shapes of buildings with correspondingly shaped compression rings or peripheral compression members.

Various modifications may be made in the structure shown and described without departing from the spirit and scope of the invention.

I claim:

1. An air-supported fabric roof structure comprising a compression ring, three sets of generally equally spaced parallel cables arranged to define a grid of generally equilateral triangles with each cable having a pair of opposite end portions pivotally connected to the compression ring, and a plurality of generally hexagonal outer roof fabric panels secured to the cables from above, each of said panels covering six triangles of the grid and having three sets of opposite edge portions, the edge portions of each set being secured respectively to two outer cables of a group of three adjacent generally parallel cables of one of the sets of cables, and an intermediate cable of the group passing beneath the panel substantially along a bisecting diagonal thereof without being attached thereto.

2. A roof structure as claimed in claim 1 including a plurality of generally hexagonal inner liner panels secured to the cables from below, each of said inner liner panels covering six triangles of the grid and having three sets of opposite edge portions, the edge portions of each set being secured respectively to two outer cables of a group of three adjacent generally parallel cables of one of the sets of cables, and an intermediate cable of the group passing above the inner liner panel substantially along a bisecting diagonal thereof without being attached thereto.

3. A roof structure as claimed in claim 2 wherein the liner panels are staggered from the outer roof panels.

4. A roof structure as claimed in claim 3 including a plurality of cable clamping means respectively clamping three cables, one from each set, together at their intersections, each cable clamping means having a base plate associated therewith for the securing thereto of end portions of elongated clamp plates for three of the hexagonal panels.

5. A roof structure as claimed in claim 4 wherein the base plates are hexagonal.

6. A roof structure as claimed in claim 4 wherein each of the cable clamping means of one group has its associated base plate above the cables for use relating to the clamping of three of the outer roof panels.

7. A roof structure as claimed in claim 4 wherein each of the cable clamping means of one group has its associated base plate below the cables for use relating to the clamping of three of the inner liner panels.

8. A roof structure as claimed in claim 4 wherein each of the cable clamping means of one group has two of the base plates associated therewith, one above the cables for use relating to the clamping of three of the outer roof panels and one below the cables for use relating to the clamping of three of the inner liner panels.

* * * * *

UNITED STATES PATENT AND TRADEMARK OFFICE

CERTIFICATE OF CORRECTION

PATENT NO. : 4,559,746

DATED : December 24, 1985

INVENTOR(S) : Michael W. Ishler

It is certified that error appears in the above-identified patent and that said Letters Patent is hereby corrected as shown below:

Title page:

Under Assignee, name should read "Owens-Corning Fiberglas Corporation, Toledo, Ohio"

Signed and Sealed this

Twenty-first Day of October, 1986

[SEAL]

*Attest:*

DONALD J. QUIGG

*Attesting Officer*

*Commissioner of Patents and Trademarks*